US008302926B2

(12) United States Patent
Gouldson

(10) Patent No.: US 8,302,926 B2
(45) Date of Patent: Nov. 6, 2012

(54) SLIP-ON HOOK

(75) Inventor: Stanley F. Gouldson, Northport, NY (US)

(73) Assignee: Spotless Plastics Pty. Ltd., Moorabbin, Victoria (AU)

( * ) Notice: Subject to any disclaimer, the term of this patent is extended or adjusted under 35 U.S.C. 154(b) by 226 days.

(21) Appl. No.: 12/751,467

(22) Filed: Mar. 31, 2010

(65) Prior Publication Data

US 2011/0240818 A1 Oct. 6, 2011

(51) Int. Cl.
*B42F 13/00* (2006.01)

(52) U.S. Cl. ..... 248/340; 248/215

(58) Field of Classification Search ..... 248/304, 248/690, 339, 340, 215, 905; 220/751; 206/806
See application file for complete search history.

(56) References Cited

U.S. PATENT DOCUMENTS

| | | | | |
|---|---|---|---|---|
| 4,155,531 | A * | 5/1979 | Bagne | 248/692 |
| 2002/0190177 | A1* | 12/2002 | Nielsen | 248/339 |
| 2006/0261230 | A1* | 11/2006 | Lee | 248/304 |
| 2007/0045136 | A1* | 3/2007 | Kim | 206/278 |
| 2011/0233347 | A1* | 9/2011 | Turvey et al. | 248/95 |

* cited by examiner

*Primary Examiner* — Ramon Ramirez
(74) *Attorney, Agent, or Firm* — Scully, Scott, Murphy & Presser, P.C.

(57) ABSTRACT

A slip-on hook, having a hook portion and a body portion connected to the hook portion, is provided. The slip-on hook releasably retains an elongated material of an article. The hook portion of the slip-on hook engages a supporting bar for hanging the article for illustration purposes. The body portion of the slip-on hook engages the elongated material of the article. The body portion has an upper flange, an opposite lower flange, and a connecting web partially connecting the upper flange and the lower flange in the middle of the flanges. Spaces are provided between the upper flange and the lower flange at either side of the connecting web for receiving the elongated material of the article.

29 Claims, 4 Drawing Sheets

SLIP-ON HOOK

BACKGROUND OF THE INVENTION

1. Field of Invention

The present invention relates generally to hooks, and more specifically, to hooks for engaging the packaging of products. Particularly, the present invention relates to hooks for engaging such packaging that is characterized by at least one cardboard edge, such as a side of a garment packaging container, such that the hooks can be conveniently slipped onto the packaging to achieve a secure yet releasable arrangement between the hook and the article, and such that the packaged product can be displayed by hanging on a support bar of a display rack.

2. Description of Related Art

Garment packaging containers, such as garment packaging boxes and bags, are widely used in department stores for containing and presenting garments, including children's wear, underwear, slips, brassieres, panties, lingerie, swimwear and the like. The garments are normally folded or otherwise arranged in the containers, while pictures and texts in connection with the garment properties, user instructions, manufacturing information and advertisements are normally printed on the surfaces of the container. Cardboard is often affixed to the packaging to facilitate this information. Based on the information derived from the pictures and texts, a customer can conveniently make decisions on his/her purchases. The garment packaging containers can be hard boxes made of paperboards, soft plastic bags, partially or fully transparent, cardboard attached to plastic bags, or combinations thereof.

Traditionally, the garment packaging containers are placed side by side on shelves in the department store, according to a certain protocol, such as the size of the garments. Alternatively, the garment packaging containers may be provided with a plastic hanging strap formed integrally with the body of the container, for hanging the containers on a spike or a support of a rack.

Disadvantages have been incurred with regard to the traditional ways of arranging garment packaging containers. For example, when the containers are placed side by side, it is always inconvenient and awkward for a store worker to rearrange the containers when a customer has inadvertently placed a container in wrong places. Furthermore, when a large number of the garment packaging containers are shipped, the hanging strap occupies valuable shipping space for the containers, which makes the packing of the containers non-compact. In addition, the hanging band is not reusable once the container is broken, which increases the cost of manufacturing and consumption of raw materials.

Accordingly, there is a need for an improved means for retaining garment packaging containers, which can be fixed to the containers to satisfactorily present the container as well as the garments in the container, and which may be released and reusable to reduce the cost and material consumption for manufacturing.

BRIEF SUMMARY OF THE INVENTION

Therefore, in order to overcome certain deficiencies of the prior art, provided according to one aspect of the present invention is a slip-on hook for releasably engaging an elongated material of an article, such as a side of a garment packaging container.

Although the present invention will be described in connection with a garment packaging container as a preferred example, a person of ordinary skill in the art understands that the disclosed mechanical features of the hook can also be applied on many other suitable objects or articles, to operatively retain an elongated material of the objects or articles. The slip-on-hook according to the present invention can be used on any packaging for any type of product, where the packaging offers at least one edge of elongated material, such as a cardboard, which permits insertion of the slip-on hook so that the product and its packaging can be hung by the hook for display. The slip-on hook can be made of any suitable material, including but not limited to, plastic, metal and the combination thereof.

The slip-on hook, according to an exemplary embodiment of the present invention, includes a hook portion and a body portion connected to the hook portion. The hook portion is configured to engage a supporting device, such as a rack or support bar, for hanging and presenting the article. The body portion is configured to engage the elongated material of the article. The body portion includes an upper flange and an opposite lower flange. The upper flange and the lower flange are partially connected to each other, such that at least one space is provided between the upper flange and the lower flange for receiving the elongated material, such as a side of the garment packaging container.

Preferably, the hook portion includes a planar web and a peripheral flange substantially surrounding the planar web. Preferably, the peripheral flange is continuous with the upper flange of the body portion.

Preferably, the body portion includes at least one connecting web partially connecting the upper flange and the lower flange.

Preferably, the body portion includes at least one strut partially connecting the upper flange and the lower flange.

Preferably, the body portion includes a protrusion extending downwardly from the upper flange of the body portion. Preferably, the body portion further includes a recess extending downwardly from the lower flange of the body portion and in substantially vertical alignment with the protrusion.

Preferably, the body portion further includes a first strut and a second strut extending between the upper flange and the lower flange. The first strut and the second strut are configured to border the connecting web between the upper flange and the lower flange, such that a first space and a second space are provided at either side of the connecting web, respectively, for receiving the elongated material of the article, such as a side of a garment packaging container. Preferably, the body portion further includes a first ridge extending upwardly from the lower flange of the body in the first space. The first ridge includes a sloped part and an elevated part continuous with the sloped part. Preferably, the body portion further includes a second ridge extending upwardly from the lower flange of the body in the second space. The second ridge includes a sloped part and an elevated part continuous with the sloped part. Preferably, the body portion further includes a recess formed in the elevated part of the second ridge and a protrusion extending downwardly from the upper flange of the body partially into the recess.

Preferably, the body portion further includes a fin extending downwardly from the lower surface of the lower flange. Preferably, the body portion further includes a recess extending from the lower flange of the body portion into the fin and a protrusion extending downwardly from the upper flange of the body and partially into the recess.

Provided according to another aspect of the present invention is a combination of a slip-on hook and an article having an elongated side. Preferably, the article is a garment packaging container having a front panel, a rear panel, an elongated middle portion connecting the front panel and the rear panel. The elongated side defines at least one opening therein. The hook includes a hook portion and a body portion. The body portion includes an upper flange connected to the hook portion, and an opposite lower flange. The upper flange and the lower flange are partially connected to each other through a connecting web. The lower flange is capable of being inserted through the opening to allow the upper flange to be disposed above the elongated side and the lower flange to be disposed below the elongated side.

Preferably, the hook portion of the slip-on hook includes a planar web and a peripheral flange substantially surrounding the planar web. Preferably, the peripheral flange is continuous with the upper flange of the body portion.

Preferably, the elongated side of the article further includes a secondary opening, and the body portion of the slip-on hook includes a protrusion extending downwardly from the upper flange of the body portion. The protrusion extends downwardly at least partially into the secondary opening, to offer an engagement between the elongated side and the protrusion. Preferably, the body portion further includes a recess extending downwardly from the lower flange of the body portion. The recess is in substantially vertical alignment with the protrusion, to allow the protrusion to partially extend into the recess through the secondary opening.

Preferably, the body portion of the slip-on hook further includes a first strut and a second strut extending between the upper flange and the lower flange. The first strut and the second strut are configured to border the connecting web between the upper flange and the lower flange, such that a first space and a second space are provided at either side of the connecting web, respectively, for receiving the elongated middle portion of the garment packaging container. Preferably, the body portion further includes a first ridge extending upwardly from the lower flange of the body in the first space. The first ridge includes a sloped part and an elevated part continuous with the sloped part. Preferably, the body portion further includes a second ridge extending upwardly from the lower flange of the body in the second space. The second ridge includes a sloped part and an elevated part continuous with the sloped part. Preferably, the body portion of the slip-on hook further includes a recess formed in the elevated part of the second ridge and a protrusion extending downwardly from the upper flange of the body partially into the recess.

Preferably, the body portion of the slip-on hook further includes a fin extending downwardly from the lower surface of the lower flange. Preferably, the body portion of the slip-on hook further includes a recess extending from the lower flange of the body portion into the fin and a protrusion extending downwardly from the upper flange of the body and partially into the recess.

BRIEF DESCRIPTION OF THE DRAWINGS

These and other features, aspects and benefits of the present invention will be made apparent with reference to the following specification and accompanying drawings, where like reference numerals refer to like features across the several views, and wherein.

DETAILED DESCRIPTION OF EXEMPLARY EMBODIMENTS OF THE INVENTION

Exemplary embodiments of slip-on hook according to the present invention will be described in detail, in connection with a garment packaging container as an example of the article having an elongated side. However, it is not intended to limit the article to the garment packaging container. A person of ordinary skill in the art understands that any article having an elongated side or edge can be used with the slip-on hook according to the present invention.

Figure 1:
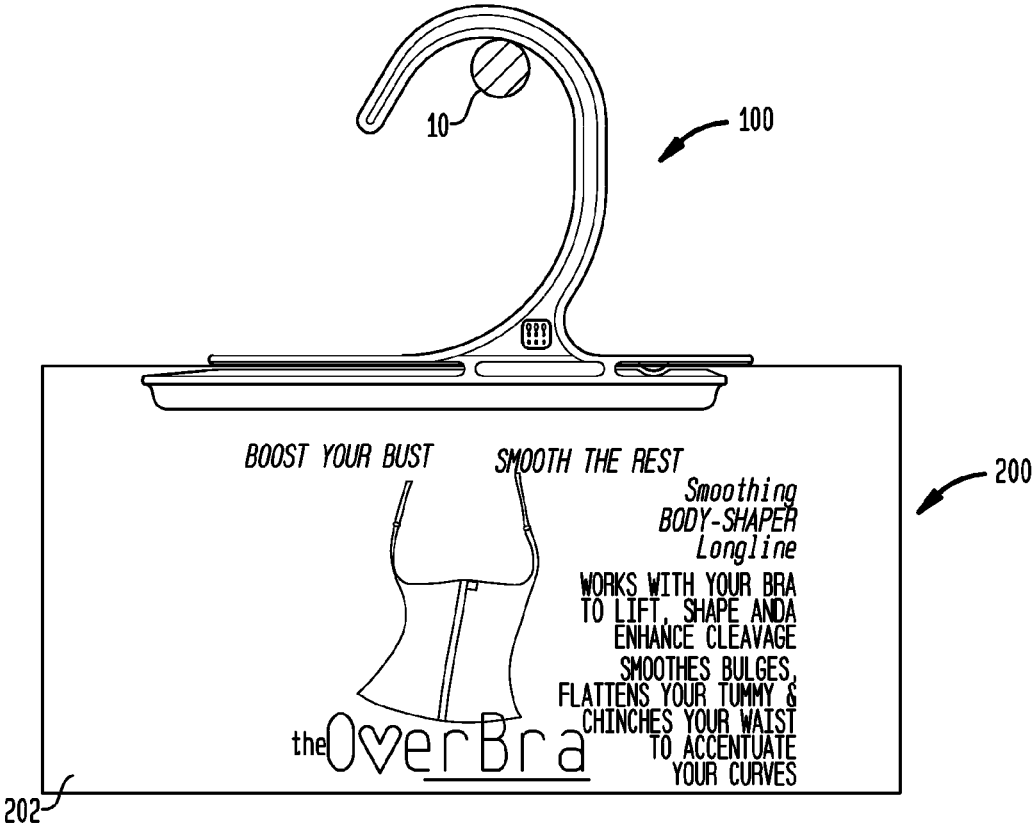
FIG. 1 is a front elevation view of a combination of a slip-on hook and a garment packaging container, according to an exemplary embodiment of the present invention.

Referring to FIG. 1, illustrated is a combination of a slip-on hook 100 and a garment packaging container 200, according to one exemplary embodiment of the present invention.

The garment packaging container 200 accommodates therein a garment and/or accessories of a garment. The garment packaging container 200 is hung to a supporting device through the hook 100, for hanging the container and the garment for the purpose of showing the garment to a customer. The garment packaging container 200 includes, but is not limited to, a paperboard box or plastic bag. Texts and/or pictures, for showing information regarding garment properties, user instructions, manufacturing information, advertisements and so on, are printed on a surface of the garment packaging container 200, for facilitating the customer's purchase of the garment.

In the shown exemplary embodiment, the garment packaging container 200 is a substantially rectangular box for containing brassieres. However, a person of ordinary skill in the art understands that the profile and/or shape of the garment packaging container may vary without departing from the present invention. Furthermore, the materials suitable for the garment packaging container 200 include, but are not limited to, hard paper board, soft plastics and the like.

In the shown embodiment, the hook 100 releasably engages the garment packaging container 200 in such a manner that the garment packaging container 200 can be hung by the hook 100 to display at least one side of the garment packaging container 200. The hook 100 further releasably engages a supporting device, such as a rack 10. The rack 10 can be of any known configuration for the purpose of supporting and conveying the combination of the hook 100 and the garment packaging container 200.

Figure 2:
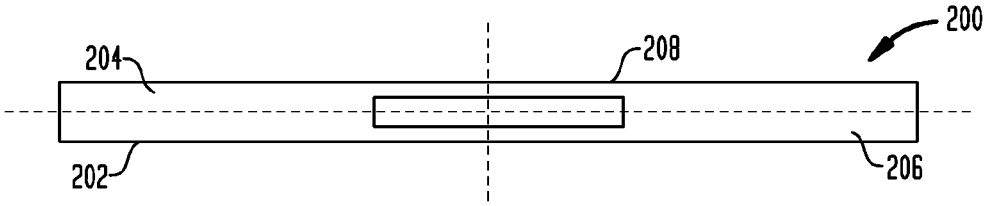
FIG. 2 is a top view of the garment packaging container shown in FIG. 1.

As shown in FIG. 2, the garment packaging container 200 includes, inter alia, a front panel 202, an opposite rear panel 204, and a middle portion 206 connecting the front panel 202 and the rear panel 204 at one side of the front panel 202 and the rear panel 204. The middle portion 206 is a substantially elongated material, and can be a hard spine, seam or a soft crease, for operatively connecting the front panel 202 and the rear panel 204. The front panel 202 includes a surface for illustrating texts and pictures.

A garment can be attached to the front panel 202 and/or the rear panel 204 through any suitable means, such as staples, tapes, adhesives and so on. Alternatively, the garment packaging container 200 may further include side panels and a bottom panel to provide a substantially closed space for accommodating the garment.

The middle portion 206 is provided with an opening 208, which can generally rectangular, substantially disposed at the middle of the middle portion 206. The opening 208 is configured to, in cooperation with the middle portion 206, releasably engage the hook 100. The opening 208 is dimensioned to admit at least a portion of the hook 100.

A person of ordinary skill in the art understands that the opening 208 can assume any suitable shape as long as it serves to releasably engage the hook 100. For example, the opening 208 may be an oval narrow slit in the middle portion 206. A person of ordinary skill in the art also understands that the present invention is applicable to any type of packaging containers.

Figure 3:
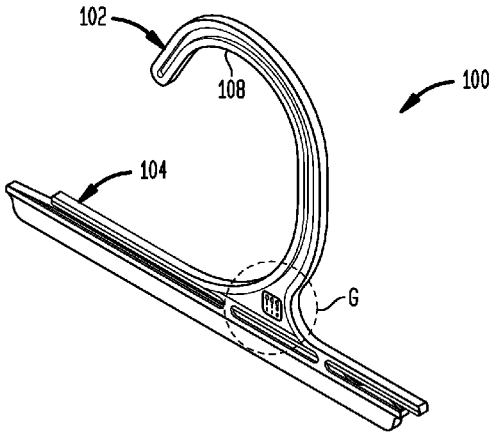
FIG. 3 is a perspective view of the slip-on hook shown in FIG. 1.
Figure 4:
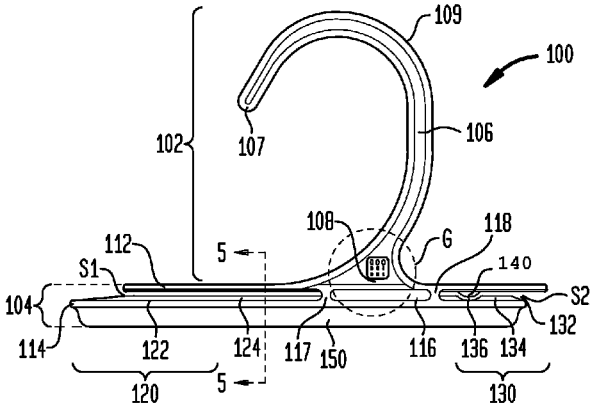
FIG. 4 is a front elevation view of the slip-on hook shown in FIG. 1.
Figure 5:
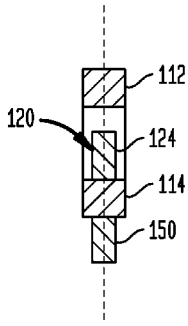
FIG. 5 is a cross section view of the slip-on hook along Lines 5-5 in FIG. 4.

FIGS. 3, 4 and 5 illustrate a perspective view, a front elevation view and a sectional view of the hook 100, respectively. The hook 100 includes a hook portion 102 for engaging the rack 10 and a body portion 104 for engaging the garment packaging container 200. The hook portion 102 and the body portion 104 are jointed to each other at a lower neck region G of the hook 100, where a lower neck indicator can be optionally mounted onto the hook 100 for displaying information related to the garment packaging container and/or the garment. For example, the hook portion 102 and the body portion 104 are formed integrally through a single molding step.

The hook portion 102 includes a substantially planar web 106, starting from a tip 107 of the hook portion 102 and ending at a lower neck end 108 of the hook portion 102. The hook portion 102 further includes a peripheral flange 109 substantially surrounding the web 106. The peripheral flange 109 engages the rack 10 or any other means for supporting the hook 100 and the container 200. For example, the peripheral flange 109 has a greater width compared to that of the web 106, such that the peripheral flange 109 provides a larger load bearing surface when the hook 100 engages the rack 10.

Furthermore, the peripheral flange 109 is curved at the lower neck region G to naturally join the body portion 104, such that a smooth interface between the hook portion 102 and the body portion 104 are provided to enhance the integrity of the entire hook 100 and the resistance of the hook 100 to twisting or flexure.

However, a person of ordinary skill in the art understands that the hook portion 102 can be any suitable hook, including but not limited to, metal wire hook, plastic molded hook, and the like.

The body portion 104 includes an upper flange 112 and an opposite lower flange 114, partially connected to each other to provide at least one space between the upper flange 112 and the lower flange 114 for receiving the middle portion 206 of the garment packaging container 200.

Specifically, the body portion 104 includes a connecting web 116 disposed between the upper flange 112 and the lower flange 114, for partially connecting the upper flange 112 and the lower flange 114. Accordingly, a first space S1 at the left side of the connecting web 116, and a second space S2, at the right side of the connecting web 116, are provided for receiving the middle portion 206 of the garment packaging container 200.

Alternatively, the body portion 104 may further include a pair of struts 117 and 118 between the upper flange 112 and the lower flange 114, for partially connecting the upper flange 112 and the lower flange 114. The struts 117 and 118 can also be provided in addition to the connecting web 116, to border the left end and right end of the connecting web 116. The struts 117 and 118 reinforce the strength of the body portion 104.

For example, the upper flange 112 and the lower flange 114 are substantially horizontal and parallel to each other; and the struts 117 and 118 are substantially vertical between the upper flange 112 and the lower flange 114. Furthermore, the peripheral flange 109 of the hook portion 102 is structurally continuous with the upper flange 112 of the body portion 104, to further enhance the strength and integrity of the hook 100.

For example, at the left side of the first strut 117, the lower flange 114 extends farther from the first strut 117 than the upper flange 112; and at the right side of the second strut 118, the upper flange 112 extends farther from the second strut 118 than the lower flange 114. Such a configuration facilitates smooth engagement between the body portion 104 and the elongated middle portion 206 of the container 200.

The body portion 104 is further provided with a first ridge 120 in the first space S1. The first ridge 120 rises from the lower flange 114 without reaching the upper flange 112. The first ridge 120 is configured to engage the middle portion 206 of the garment packaging container 200, so as to securely retain the middle portion 206 between the first ridge 120 and upper flange 112.

The first ridge 120 includes a sloped part 122, for facilitating the initial insertion of the middle portion 206 into the space S1 between the first ridge 120 and the upper flange 112, and an elevated part 124 continuous to the sloped part 122, for positively retaining the middle portion 206. Preferably, the sloped part 122 is formed from the left most end of the lower flange 114. Preferably, the first ridge 120 has a smaller width than that of the upper flange 112 and lower flange 114, as best seen from FIG. 5.

At the right side of the second strut 118, the body portion 104 is further provided with a second ridge 130 rising from the lower flange 114 without reaching the upper flange 112. Similarly, the second ridge 130 is configured to engage the middle portion 206 of the garment packaging container 200, to securely retain the middle portion 206 between the second ridge 130 and upper flange 112.

The second ridge 130 includes a sloped part 132 and an elevated part 134 continuous to the sloped part 132. The sloped part 134 is configured to facilitate the initial insertion of the middle portion 206 into the space S2 between the second ridge 130 and the upper flange 112. The elevated part 134 is configured to positively retain the middle portion 206. The sloped part 132 is formed from the right most end of the lower flange 114.

For example, the second ridge 130 further includes a recess 136 formed in the elevated part 134. A downward protrusion 140, having a substantially complementary profile of the recess 136, is formed to extend downwardly from the upper flange 112 toward the recess 136 but not to reach the second ridge 130. The recess 136 and the downward protrusion 140 are in a substantially vertical alignment with each other. Thus, a curved distance is provided between the protrusion 140 and the recess 136.

In the shown embodiment, the recess 136 and the corresponding protrusion 140 are substantially semi-circular. However, any other suitable profile and shape for the recess 136 and the protrusion 140 can be used in place of or in addition to, the specific structures as shown, such as complementary triangle-shaped protrusion and recess.

In operation, once the middle portion 206 (shown in FIG. 1) of the container 200 enters the space S2 between the second ridge 130 and the upper flange 112 and subsequently passes through the complementary protrusion 140 and recess 136, at least a part of the middle portion 206 is deformed by the protrusion 140 and the recess 136. The deformation of the middle portion 206 securely retains the middle portion 206 between the second ridge 130 and the upper flange 112, and prevents inadvertent release of the middle portion 206. For example, the second ridge 130 has a smaller width than that of the upper flange 112 and lower flange 114.

Alternatively, the middle portion 206 of the container 200 may include an opening, through which the downward protrusion 140 passes to be partially or completely positioned into the recess 136. In this way, the protrusion 140 and the recess 136, in cooperation with the opening, lock the middle portion 206 of the container 200 between the upper flange 112 and the lower flange 114 of the body portion 104, thereby preventing the inadvertent release of the middle portion 206.

Figure 6:
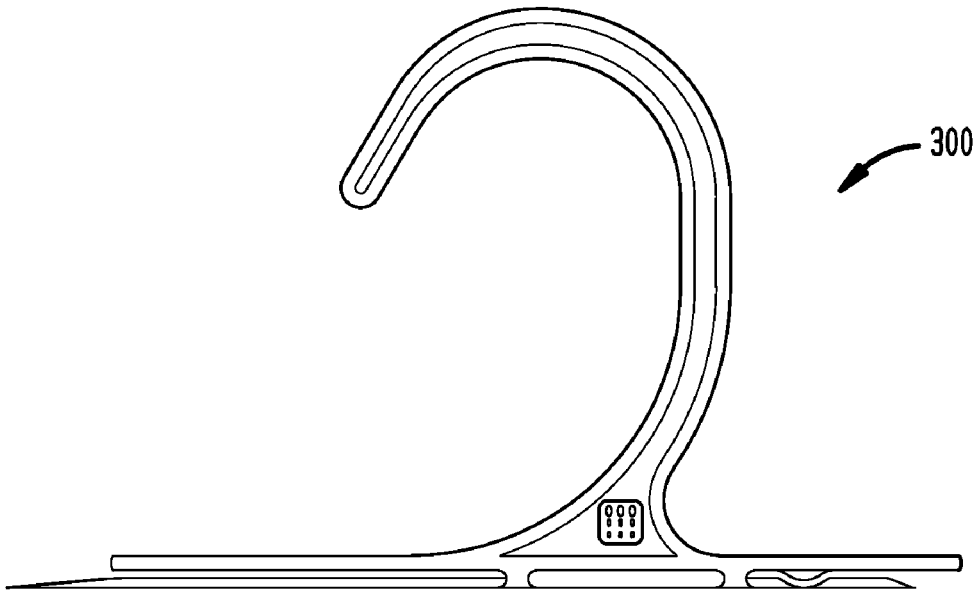
FIG. 6 is a front elevation view of a slip-on hook according to another exemplary embodiment of the present invention.

Optionally, the body portion 104 further includes a fin 150 extending downwardly from the lower flange 114. The fin 150 is in the form of a thin material for further reinforcing the strength of the entire hook 100. For example, the fin 150 has a smaller width than that of the upper flange 112 and lower flange 114, as best seen from FIG. 5. The fin 150 can be omitted to save the material used for manufacturing the hook, as shown in FIG. 6, which illustrates a slip-on hook 300 according to another exemplary embodiment of the present invention.

In the operation to attach the hook 100 to the container 200, a user first inserts the first ridge 120, the lower flange 114 and the fin 150 into the container 200 through the opening 208 formed in the middle portion 206, while keeping the upper flange 112 on top of the middle portion 206. Consequently, the middle portion 206 is received in the first space S1 between the first ridge 120 and the upper flange 112. The sloped part 122 facilitates a smooth insertion of the first ridge 120, the lower flange 114 and the fin 150 into the container 200.

Subsequently, the user moves the hook 100 toward the left side of the container 200 to expose enough space of the opening 208 to admit the right portion of the hook. Specifically, the second ridge 130, the lower flange 114 and the fin 150 are inserted under the middle portion 206 through the opening 208, while keeping the upper flange 112 and the protrusion 140 on top of the middle portion 206. The sloped part 132 facilitates a smooth insertion of the second first ridge 130, the lower flange 114 and the fin 150 into the container 200.

Subsequently, the hook 100 is moved toward the right side of the container 200, to ultimately place the hook 100 substantially in the middle of the container 200. The opening 208 is properly dimensioned, such that the user is able to maneuver the hook 100 to insert the first ridge 120, the second ridge 130, the lower flange 114 and the fin 150 into the container 200, while maintaining sufficient material of the middle portion 206 sandwiched between the upper flange 112 and the lower flange 114 to properly hang the container 200.

With the advancement of the middle portion 206 into the space S2 between the second ridge 130 and the upper flange 112, the middle portion 206 deforms to follow the curved contour defined by the protrusion 140 and the recess 136. The deformation ensures a secure engagement between the hook 100 and the container 200.

Alternatively, in case the middle portion 206 of the container 200 is provided with a corresponding opening for allowing the protrusion 140 to pass though the opening and subsequently advance partially into the recess, the interference, between the protrusion 140 and the material of the middle portion 206 defining the opening, locks the middle portion 206 between the upper flange 112 and the lower flange 114.

The final assembly of the hook 100 and the container 200 can be readily suspended onto the rack 10, or any other suitable structure, for displaying the whole package to the customers.

On the other hand, the user can reverse the above steps to release the container 200 from the hook 100.

Figure 7:
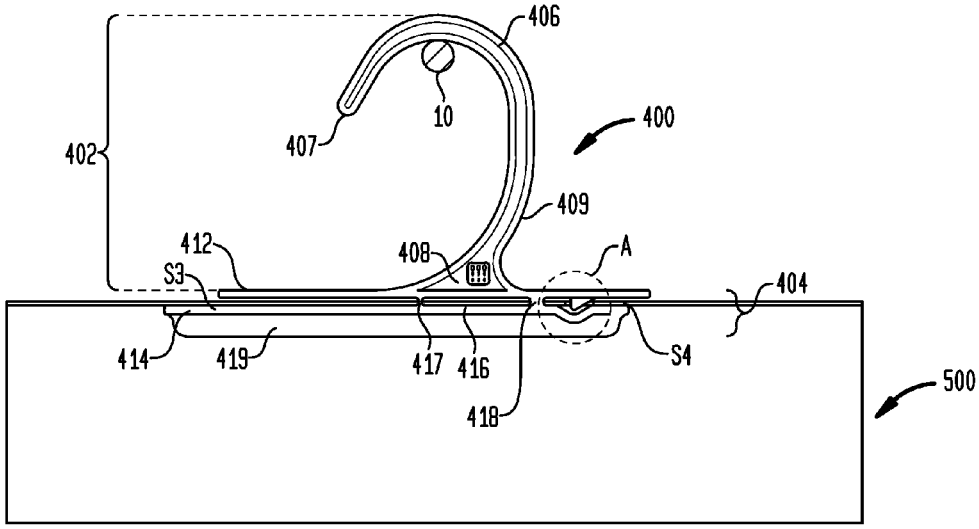
FIG. 7 is a front elevation view of a combination of a slip-on hook and a garment packaging container according to still another exemplary embodiment of the present invention.
Figure 7A:
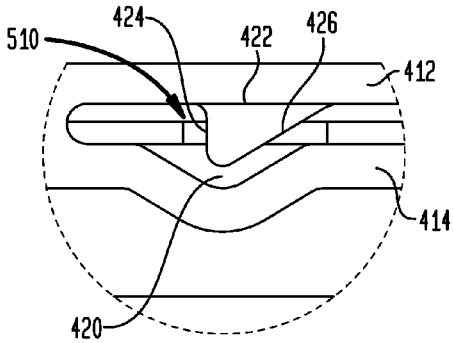
FIG. 7A is an enlarged view of the region A shown in FIG. 7.
Figure 8:
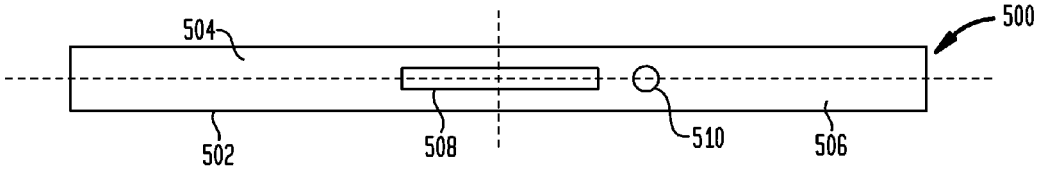
FIG. 8 is a top view of the garment packaging container shown in FIG. 7.

FIGS. 7, 7A and 8 show the combination of a hook 400 and a garment packaging container 500, according to another exemplary embodiment of the present invention, wherein a locking mechanism between the hook and the container is provided for preventing inadvertent release of the container.

As shown in FIG. 8, the garment packaging container 500 includes a front panel 502, an opposite rear panel 504, and a middle portion 506 connecting the front panel 502 and the rear panel 504. The middle portion 506 is a substantially elongated material, and can be a hard spine or a soft crease. The middle portion 506 is provided with a generally rectangular opening 508, substantially disposed at the middle of the middle portion.

The middle portion 506 is further provided with a generally circular opening 510, disposed at either side of the opening 508. The opening 510 is configured to allow a locking extension of the hook 400 to pass through. It should be understood by a person of ordinary skill in the art that any other suitable shape for the openings 508 and 510 can be applied.

The hook 400 includes a hook portion 402 for engaging a supporting device and a body portion 404 for engaging the garment packaging container 500. The hook portion 402 and the body portion 404 are joined at a lower neck region of the hook 400; where a lower neck indicator can be optionally mounted onto the hook 400 for displaying information related to the garment retained by the garment packaging container. For example, the hook portion 402 and the body portion 404 are formed integrally through a single molding step.

The hook portion 402 includes a substantially planar web 406, starting from a tip 407 of the hook portion and ending at a lower neck end 408 of the hook portion. The hook portion 402 further includes a peripheral flange 409 substantially surrounding the planar web 406. The peripheral flange 409 engages the supporting device for suspending the hook 400 as well as the container 500. For example, the peripheral flange 409 has a greater width compared to that of the web 406, such that the peripheral flange 409 provides a larger load bearing surface when the hook 400 engages the rack 10.

Furthermore, the peripheral flange 409 is curved at the lower neck region of the hook 400 to naturally join the body portion 404, such that a smooth interface is provided between the hook portion 402 and the body portion 404 to enhance the integrity of the entire hook and the resistance of the hook to twisting or flexure. A person of ordinary skill in the art understands that any suitable hook can be applied without departing from the present invention. For example, the hook portion 402 can be a metal wire hook.

The body portion 404 includes an upper flange 412 and an opposite lower flange 414, partially connected to each other, such that at least one space is provided between the upper flange 412 and the lower flange 414 to receive the middle portion 506 of the garment packaging container 500. Preferably, the body portion 404 includes a connecting web 416 partially connecting the upper flange 412 and the lower flange 414.

Accordingly, a first space S3, at the left side of the connecting web 416, and a second space S4, at the right side of the connecting web 416, are provided. The first space S3 and the second 84 are adapted for receiving at least a portion of the middle portion 506 of the garment packaging container 500.

Alternatively, the body portion 404 may further include a pair of struts 417 and 418 extending between the upper flange 412 and the lower flange 414, for partially connecting the upper flange 412 and the lower flange 414. The struts 417 and 418 can be disposed to border the connecting web 416. The struts 417 and 418 are configured to reinforce the strength of the body portion 404. For example, the upper flange 412 and the lower flange 414 are substantially horizontal and parallel to each other; and the struts 417 and 418 are substantially vertical between the upper flange 412 and the lower flange 414.

Preferably, the peripheral flange 409 of the hook portion 402 is structurally continuous with the upper flange 412 of the body portion 404, to further enhance the strength and integrity of the hook 400. The upper flange 412 and the lower flange 414 are spaced from each other, outside of the region defined by the connecting web 416 and the struts 417, 418.

Preferably, at the left side of the first strut 417, the lower flange 414 extends farther from the first strut 417 than the upper flange 412; and at the right side of the second strut 418, the upper flange 412 extends farther from the second strut 418 than the lower flange 414. Such a configuration facilitates engagement between the body portion 404 of the hook 400 and the middle portion 506 of the container 500.

The body portion 404 further includes a fin 419 integral with the lower flange 414 and extending downwardly from the lower flange 414. Similar to the fin 150 of the hook 100, the fin 419 enhances the strength of the hook 400. Optionally, the body portion 404 may further include ridges (not shown), rising from the lower flange 414 toward the upper flange 412, for improving the retaining capacity of the hook 400. For example, the ridges include a sloped part for facilitating the insertion of the lower flange 414 into the container 500.

FIG. 7A is an enlarged view of the region A in FIG. 7, depicting the locking features offered by this embodiment. The body portion 404 further includes a recess 420 extending downwardly into the fin 419. Accordingly, the lower flange 414 is at least partially recessed. The body portion 404 further includes a downward protrusion 422, formed integrally with the upper flange 412, extending downwardly from the upper flange 412 and partially or completely into the recess 420. The recess 420 and the protrusion 422 have at least partially complementary profiles for operatively engaging the middle portion 506 of the container 500. The recess 420 and the downward protrusion 422 are in substantially vertical alignment with each other.

In the shown embodiment, the recess 420 is substantially triangular. Correspondingly, the protrusion 422 is substantially triangular, having a vertical surface 424 extending substantially vertically from the upper flange 412 and a slanted surface 426 connecting the vertical surface 424 and upper flange 412. However, a person of ordinary skill in the art understands that any other suitable complementary profiles for the recess and the protrusion are applicable.

In use, a user first inserts the lower flange 414 and the fin 419 into the container 500 through the opening 508 formed in the middle portion 506, while keeping the upper flange 412 on top of the middle portion 506. Thus, the middle portion 506 enters the first space 83 and is partially retained between the upper flange 412 and the lower flange 414 at the left side of the connecting web 416. Subsequently, the user moves the hook 400 toward the left side of the container 500, to allow the lower flange 414 and the fin 419 at the right side to be disposed under the middle portion 506, while keeping the upper flange 412 and the protrusion 422 on top of the middle portion 506. Accordingly, the middle portion 506 enters the second space 84 and is partially retained between the upper flange 412 and the lower flange 414 at the right side of the connecting web 416.

Subsequently, the user moves the hook 400 to the right side of the container 500, to position the hook 400 substantially in the middle of the middle portion 506. With the advancement of the middle portion 506 into the second space S4 between the upper flange 412 and the lower flange 414, the protrusion 422 is moved toward the light of the container 500 along the middle portion 506, until it partially enters the recess 420 through the opening 510. During the movement of the protrusion 422 rightward, the slanted surface 426 facilitates a smooth movement of the protrusion 422. Once the protrusion 422 partially enters the recess 420, the vertical surface 424 is capable of engaging the material of the middle portion 506 between the opening 508 and the opening 510, thereby preventing the middle portion 506 from sliding off the hook 400. Accordingly, the container 500 is locked relative to the hook 400. In this aspect, the opening 510, the recess 420 and the protrusion 422 are formed to have corresponding positions, to ensure that the protrusion 422 is capable of extending through the opening 510 and further partially entering into the recess 420.

The hook of the present invention can be manufactured from suitable material, including but not limited to, metal material, paper, plastic material, or the combinations thereof. For example, the plastic material suitable for the hook according to the present invention includes one or more of polystyrene, SAN, ABS, PPO, nylon, polypropylene (PP), polyethylene, PET, polycarbonates (PC), acrylics, K-resin, and polyvinyl chloride (PVC) among others.

From the foregoing illustrations it is readily apparent that the present invention is directed to a molded plastic slid-on hook suitable for mass production, for example, through injection molding.

The present invention has been described with respect to certain exemplary embodiments. Certain alterations and/or modifications will be apparent to those skilled in the art, in light of the instant disclosure, without departing from the spirit or the scope of the invention. These embodiments are offered as merely illustrative, and not limiting, on the scope of the invention, which is defined solely with reference to the following appended claims.

I claim:

1. A hook for an article, comprising:

a hook portion; and a body portion connected to the hook portion, configured to engage an elongated material of the article, the body portion comprising an upper flange and an opposite lower flange, the upper flange and the lower flange partially connected to each other, such that at least one space is provided between the upper flange and the lower flange for receiving the elongated material of the article, wherein the body portion further comprises a protrusion extending downwardly from the upper flange.

2. The hook according to claim 1, wherein the hook portion comprises a planar web and a peripheral flange substantially surrounding the planar web.

3. The hook according to claim 2, wherein the peripheral flange is continuous with the upper flange of the body portion.

4. The hook according to claim 1, wherein the body portion further comprises a fin extending downwardly from the lower flange.

5. The hook according to claim 1, wherein the body portion comprises at least one connecting web partially connecting the upper flange and the lower flange.

6. The hook according to claim 5, wherein the body portion further comprises a first strut and a second strut extending between the upper flange and the lower flange, the first strut and the second strut being configured to border the connecting web between the upper flange and the lower flange, such that a first space and a second space are provided at either side of the connecting web, respectively, for receiving the elongated material of the article.

7. The hook according to claim 6, wherein the body portion further comprises a first ridge extending upwardly from the lower flange of the body in the first space.

8. The hook according to claim 7, wherein the first ridge comprises a sloped part and an elevated part continuous with the sloped part.

9. The hook according to claim 8, wherein the body portion further comprises a second ridge extending upwardly from the lower flange of the body in the second space.

10. The hook according to claim 9, wherein the second ridge comprises a sloped part and an elevated part continuous with the sloped part.

11. The hook according to claim 10, wherein the body portion further comprises a recess formed in the elevated part of the second ridge and a protrusion extending downwardly from the upper flange of the body partially into the recess.

12. The hook according to claim 5, wherein the body portion further comprises a fin extending downwardly from the lower flange.

13. The hook according to claim 12, wherein the body portion further comprises:

a recess extending from the lower flange of the body portion into the fin; and a protrusion extending downwardly from the upper flange of the body and partially into the recess.

14. The hook according to claim 1, wherein the body portion comprises at least one strut partially connecting the upper flange and the lower flange.

15. The hook according to claim 1, wherein the body portion further comprises a recess extending downwardly from the lower flange of the body portion and in substantially vertical alignment with the protrusion.

16. A combination comprising:

an article comprising an elongated side, the elongated side defining at least one opening therein; and a hook comprising a hook portion and a body portion, the body portion comprising an upper flange connected to the hook portion, a lower flange opposite to the upper flange, and a web for partially connecting the upper flange and the lower flange, wherein the lower flange is capable of being inserted through the opening to allow the upper flange to be disposed above the elongated side and the lower flange to be disposed below the elongated side.

17. The combination according to claim 16, wherein the hook portion of the hook comprises a planar web and a peripheral flange substantially surrounding the planar web.

18. The combination according to claim 17, wherein the peripheral flange is continuous with the upper flange of the body portion.

19. The combination according to claim 16, wherein the body portion of the hook comprises a fin extending downwardly from the lower flange.

20. The combination according to claim 16, wherein: the elongated side further defines at least one secondary opening therein; and the body portion of the hook comprises a protrusion extending downwardly from the upper flange of the body portion, the protrusion extending at least partially into the secondary opening to provide an engagement between the protrusion and the elongated side, when the upper flange is disposed above the elongated side and the lower flange is disposed below the elongated side.

21. The combination according to claim 20, wherein the body portion of the hook further comprises a recess extending downwardly from the lower flange of the body portion, the recess being in substantially vertical alignment with the protrusion and the secondary opening, such that the protrusion partially extends into the recess through the secondary opening.

22. The combination according to claim 20, wherein the body portion of the hook comprises a first strut and a second strut extending between the upper flange and the lower flange, the first strut and the second strut being configured to border the connecting web between the upper flange and the lower flange, such that a first space and a second space are provided at either side of the connecting web, respectively, for receiving the elongated side of the article.

23. The combination according to claim 22, wherein the body portion of the hook comprises a first ridge extending upwardly from the lower flange of the body in the first space.

24. The combination according to claim 23, wherein the first ridge comprises a sloped part and an elevated part continuous with the sloped part.

25. The combination according to claim 24, wherein the body portion of the hook comprises a second ridge extending upwardly from the lower flange of the body in the second space.

26. The combination according to claim 25, wherein the second ridge comprises a sloped part and an elevated part continuous with the sloped part.

27. The combination according to claim 26, wherein the body portion of the hook further comprises a recess formed in the elevated part of the second ridge and a protrusion extending downwardly from the upper flange of the body partially into the recess.

28. The combination according to claim 20, wherein the body portion of the hook further comprises a fin extending downwardly from the lower flange.

29. The combination according to claim 28, wherein the body portion of the hook further comprises: a recess extending from the lower flange of the body portion into the fin; and a protrusion extending downwardly from the upper flange of the body and partially into the recess.

* * * * *